United States Patent [19]

Bosworth et al.

[11] Patent Number: 4,925,399

[45] Date of Patent: May 15, 1990

[54] CORD CLIP

[76] Inventors: Dean Bosworth; Larry Herlth, both of 329 Mahogany Dr., Key Largo, Fla. 33037

[21] Appl. No.: 202,253

[22] Filed: Jun. 6, 1988

[51] Int. Cl.[5] ..... H01R 13/62

[52] U.S. Cl. ..... 439/370; 439/369

[58] Field of Search ..... 439/369, 370, 296, 470, 439/471, 472

[56] References Cited

U.S. PATENT DOCUMENTS

| | | | |
|---|---|---|---|
| 1,989,823 | 2/1935 | Raabe | 439/369 X |
| 2,720,633 | 10/1955 | Westberg | 439/269 |
| 4,097,105 | 6/1978 | Zumwalt | 439/369 |
| 4,145,105 | 3/1979 | Dobson | 439/369 |
| 4,183,603 | 1/1980 | Donarummo | 439/369 |
| 4,184,732 | 1/1980 | Hudson | 439/369 |
| 4,206,961 | 6/1980 | Cifalde | 439/369 |
| 4,221,449 | 9/1980 | Shugart | 439/369 |
| 4,463,999 | 8/1984 | Knickerbocker | 439/369 |
| 4,643,505 | 2/1987 | House | 439/369 |
| 4,664,463 | 5/1987 | Carmo | 439/369 |

*Primary Examiner*—Eugene F. Desmond

*Attorney, Agent, or Firm*—Malloy & Malloy

[57] ABSTRACT

A cord clip for maintaining electrical connection of a male electrical plug on a first conductor to a mating female electrical plug on a second conductor wherein the clip is composed of a first and second telescopically engaged tubular length with a tension spring captivated therein and normally urging the tubular lengths toward one another yet yieldable for axial movement of the lengths away from one another and wherein each of the tubular lengths includes a cord holding channel each affective to embrace one of the cords adjacent the electrical plug to hold the plugs together under the influence of the tension spring.

3 Claims, 1 Drawing Sheet

CORD CLIP

FIELD OF THE INVENTION

This invention relates to a clip for holding the plugs of conductors together to guard against accidental disconnection of connected electrical extension cords and the like.

DESCRIPTION OF THE PRIOR ART

The problem of maintaining electrical plugs in engagement with one another has long existed and numerous patents have addressed this problem. Illustrative of prior art patents:

U.S. Pat. No. 2,720,633 is of a clamp for electrical connectors to hold them together wherein a C-shaped spring member with bifurcated ends is provided to engage the conductors of each plug to hold them together.

U.S. Pat. No. 4,097,105 is of a harness for use with a coupled plug and socket wherein ring-like members are coupled to elongated connectors so that the harness can be applied to a variety of plug socket combination and wherein the ring-like members are adjustable.

U.S. Pat. No. 4,145,105 is of a device which includes a conical shaped plug receptacle to receive any of a plurality of different sized electrical plugs and a section with detent slot for holding the cord affixed to the plug while a second section is provided having a section detent adapted to receive a second electrical cord with the first and second sections being adjustably connected together to avoid accidental disconnection of the plugs when in electrical engagement with one another.

U.S. Pat. No. 4,183,603 is of a clip for holding electrical plugs and their associated conductors in electrical engagement with one another wherein the clip is U-shaped, made of rubber and provided with holes into which the cords are received while the plugs are received between the U-shaped ends of the clip.

U.S. Pat. No. 4,184,732 is of a retaining device to hold electrical plugs in electrical engagement and wherein the device is composed of a resilient C-shaped clamp which abuts the opposite ends walls of the plug and socket with a flexible chain being utilized together with a pair of retaining straps to prevent withdrawal of the plug from the socket.

U.S. Pat. No. 4,206,961 is of a device including an elongate rod with resilient convolutions on the opposite ends which are adapted to receive the cords of mating plugs when in electrical engagement with one another.

U.S. Pat. No. 4,221,449 is of a device for maintaining electrical engagement of a plug and socket which is composed of a longitudinal bar with a serrated surface and a fixed member on one end of the bar and an adjustable moving locking member on the other end for gripping the electrically connected plug and socket therebetween.

U.S. Pat. No. 4,463,999 is of a device for connecting electrical cable connectors together composed of a bracket and a locking strap wrapped around the cable connectors.

U.S. Pat. No. 4,643,505 is of a device which includes a housing which receives the plugs and which is composed of a clam shell-like structure for hinged swinging movement about the plugs to embrace the same.

U.S. Pat. No. 4,664,463 is of a clamp to maintain electrical connection of a plug and socket wherein the connected members are inserted in a central space and clamped together.

In applicant's device, the clip is composed of a pair of telescopically interconnected tubular lengths held in a first normal telescoped position and yieldable for axial movement and, further, wherein cord holding spring means are provided on each of the tubular lengths so that when the plug and socket of an electrical connection are electrically engaged, the separate cords are gripped adjacent each plug and maintained in electrical engagement under the influence of the spring means.

SUMMARY OF THE INVENTION

This invention is of an extension cord clip which is composed of a pair of telescopically interconnected tubular lengths normally urged into a first position with respect to one another and by tension spring means and wherein each of the lengths has a clip means to receive the cord of an electrical conductor or extension cord adjacent its associated plug so that once the plug and socket of an electrical connection are interconnected, the telescopic lengths are separated somewhat and their associated cords positioned in the device to be held by the spring tension in electrical engagement.

DESCRIPTION OF THE PREFERRED EMBODIMENT

Figure 1:
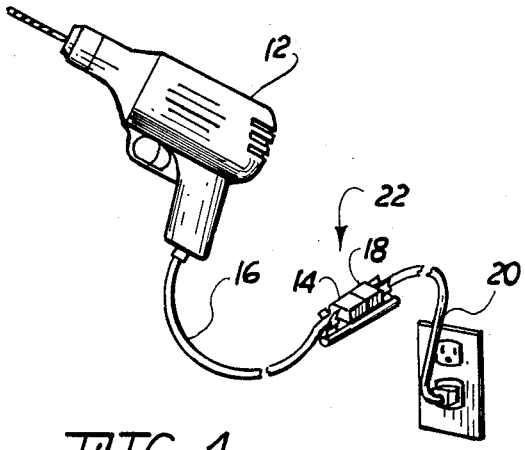
FIG. 1 is a general view illustrating the use of the present invention.

When workmen are using electrical appliances, such as that designated by the numeral 12, for example, on a ladder, the electrical plug 14 on the pigtail or cord 16 of the appliance often becomes accidentally disconnected from the plug 18, which through its cord 20, connects the appliance to an electrical source, not shown. This is indicated at 22 generally.

Figure 2:
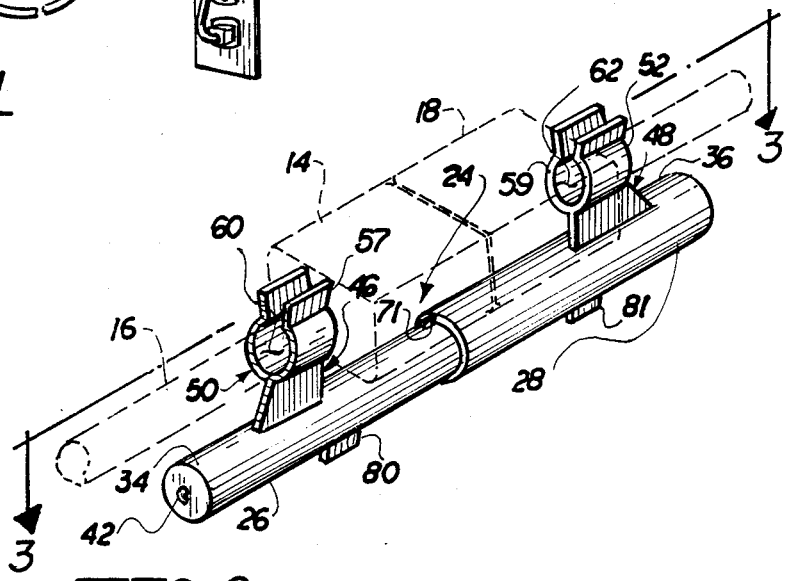
FIG. 2 is a perspective view illustrating the clip.
Figure 3:
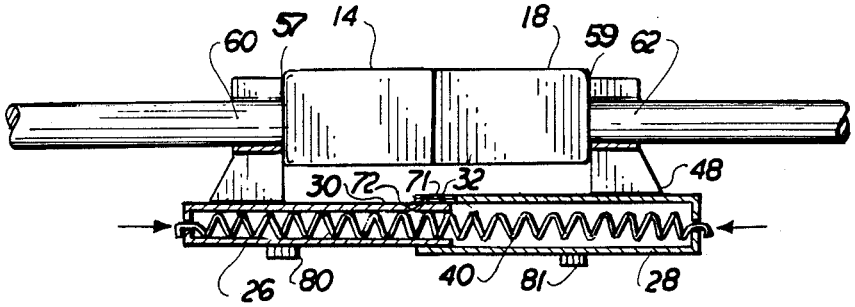
FIG. 3 is a view in cross-section taken on the plane indicated by the line 3—3 of FIG. 2 and looking in the direction of the arrows.

This invention provides a clip to normally maintain the plugs in electrical engagement with one another. The clip is shown generally in FIG. 2 and is designated by the numeral 24. It is seen to include a first smaller diameter tubular length 26 in telescopic engagement with a second tubular length 28 of a slightly larger diameter. Each of the tubular lengths has an inner end 30 and 32, see FIG. 3, and an outer end 34 and 36, the inner end of one being received in the inner end of the other. Within the tubular lengths there is a tension spring means 40 normally urging the tubular lengths toward one another and into a first normal position. Suitable means, such as 42 are provided to connect the opposite ends of the spring 40 to the lengths, for example, to the outer ends 34 and 36 respectively of the tubular lengths. Adjacent the proximal end of each of the cord lengths a cord holding channel structure means such as 46 and 48 are provided. Each of these structure means includes an axially aligned radially outwardly opening constricted mouth 60 and 62, each sized to receive and embrace one of the conductors adjacent its associated plug. In the preferred embodiment, key means in the form of an axial groove 71 and a radial pin 72 may be provided to mate with one another to maintain the telescopically engaged lengths against rotation of one with respect to the other while in telescoping engagement. Preferably, the mouths 60 and 62 are formed of spring clip-like means which are yieldable to open and are normally urged into a closed position tightly embracing the cords. The axially extending channel openings are sized to receive a length of the cords. The confronting faces 57 and 59 opposite faces 50 and 52 are axially spaced a distance corresponding to the overall length of the male and female plugs when in electrical engagement with one another so that the faces 57 and 59 bear against the plugs holding them together by the spring tension, see FIG. 3.

In use, after the plugs have been electrically connected together, the telescopic lengths are moved apart somewhat so that the electrical connected plugs may be positioned in the cord holding channel structure means. Thereafter, the tension on the spring in the tubular lengths is allowed to relax. This grips the connected plugs. The cords may be adjusted if required.

When tension thereafter, is applied to the pigtail 16, for example, the tension of the spring within the tubular lengths connecting them together will yieldingly maintain the plugs in electrical engagement. Preferably, the tension of the spring is sufficient to accommodate a substantial portion of the weight of the length of a conductor 20 connected to a source so that the electrical connection will not become inadvertently disconnected. For loading the device, that is for moving the tubular lengths apart, there may be handle means 80 and 81 provided on the tubular lengths.

It is thus seen that there is provided a device highly useful for workmen for connecting the pigtail of an appliance to an electrical conductor or for connecting to two conductors together which have mating plugs.

While the instant invention has been shown and described in what is considered to be a practical and preferred embodiment, it is recognized that departures may be made therefrom within the spirit and scope of this invention which is, therefore, not to be limited except as set forth in the claims hereinafter and in accordance with the doctrine of equivalents.

What is claimed is:

1. A clip for maintaining (a) a male electrical plug of a first axial length on a first electrical cord and (b) a female plug of a second axial length on a second electrical cord in mating electrical engagement, wherein each of the plugs has a surface confronting one another when the plugs are in electrical engagement and in opposite axial face about the first and second cords respectively, said clip comprising:

a first and a second tubular length in telescopic engagement with one another, each tubular length having an inner and an outer end, one of said inner ends being sized for receipt in the inner end of the other of said inner ends, a cord holding channel structure means on and adjacent the outer end of each tubular length, each of said structures including an axially aligned radially opening constricted mouth sized to receive and embrace one of said cords adjacent its associated plug, and each said channel structure means having an axial surface and said axial surface confronting one another, tension spring means interconnecting the lengths and normally urging the tubular lengths and respective associated channel structure means and confronting axial surfaces toward one another and into a normal position with confronting axial surfaces being spaced apart less than the sum of the first and second axial lengths of the plugs, and yieldable for axial telescopic movement of the tubular lengths so that the axial facing surfaces are spaced from one another a distance greater than the sum of the first and second plug axial lengths to accommodate insertion of the male and female plugs, when in electrical engagement with one another between the channel structure means, with the first electrical cord in one of the radial openings and the second electrical cord in the other radial opening, handle means attached to each of said tubular lengths to accommodate axial movement of said tubular lengths axially away from one another, means to maintain opposite ends of said tension spring means in engagement with an inner surface of each of said tubular lengths.

2. The device as set forth in claim 1 including key means keying the lengths from rotation with respect to one another.

3. The device as set forth in claim 1 wherein said cord holding channel structure means includes a first and a second spring clip means sized to receive an electrical cord adjacent its associated plug and to tightly embrace the same and yieldable for insertion of the cords therein.

* * * * *